US009017236B1

(12) United States Patent
Aviles

(10) Patent No.: US 9,017,236 B1
(45) Date of Patent: Apr. 28, 2015

(54) EXERCISING ASSEMBLY

(71) Applicant: Freddy N. Aviles, Miami, FL (US)

(72) Inventor: Freddy N. Aviles, Miami, FL (US)

( * ) Notice: Subject to any disclaimer, the term of this patent is extended or adjusted under 35 U.S.C. 154(b) by 70 days.

(21) Appl. No.: 13/864,410

(22) Filed: Apr. 17, 2013

(51) Int. Cl.
*A63B 21/00* (2006.01)
*A63B 26/00* (2006.01)
*A63B 23/02* (2006.01)

(52) U.S. Cl.
CPC ..... *A63B 23/0211* (2013.01)

(58) Field of Classification Search
CPC .... A63B 22/20; A63B 22/201; A63B 22/203; A63B 22/208; A63B 23/0211; A63B 23/0227; A63B 2208/0214; A63B 2208/0219
USPC ..... 482/51–53, 70, 71, 132, 140, 92, 131, 482/135, 136, 141, 142
See application file for complete search history.

(56) References Cited

U.S. PATENT DOCUMENTS 4,111,417 A 9/1978 Gardner
5,000,442 A * 3/1991 Dalebout et al. ..... 482/70
5,277,681 A * 1/1994 Holt ..... 482/112
5,904,641 A * 5/1999 Huang ..... 482/131
6,352,495 B1 * 3/2002 Hsu ..... 482/92
6,786,850 B2 * 9/2004 Nizamuddin ..... 482/51
6,821,231 B1 * 11/2004 Hall ..... 482/51
D508,097 S 8/2005 Perez
7,125,367 B1 * 10/2006 Stearns ..... 482/141
7,134,987 B2 11/2006 Goldstein
7,294,100 B2 * 11/2007 Bull ..... 482/51
7,402,126 B2 * 7/2008 Chang ..... 482/52
7,645,218 B2 * 1/2010 Potok ..... 482/141
7,780,585 B1 8/2010 Rivas
7,846,073 B2 * 12/2010 Summers ..... 482/70
8,137,250 B1 * 3/2012 Caban ..... 482/140
8,137,251 B2 * 3/2012 Tozzi ..... 482/141
2004/0077468 A1 4/2004 Myles, Sr. et al.
2009/0098988 A1 4/2009 Kennedy

* cited by examiner

*Primary Examiner* — Stephen Crow
*Assistant Examiner* — Gregory Winter

(57) ABSTRACT

A exercising assembly includes an elongated member having a first end and a second end. A mount is attached to the second end of the elongated member. A pair of body extenders is provided and each of the body extenders is attached to the mount. The elongated member is positioned between the body extenders. The body extenders are gripped to form a support point for a person's body as the person moves their torso toward or away from the elongated member.

8 Claims, 4 Drawing Sheets

EXERCISING ASSEMBLY

BACKGROUND OF THE DISCLOSURE

Field of the Disclosure

The disclosure relates to abdominal exercising devices and more particularly pertains to a new abdominal exercising device for assisting a person in exercising their abdominal muscles.

SUMMARY OF THE DISCLOSURE

An embodiment of the disclosure meets the needs presented above by generally comprising an elongated member having a first end and a second end. A mount is attached to the second end of the elongated member. A pair of body extenders is provided and each of the body extenders is attached to the mount. The elongated member is positioned between the body extenders. The body extenders are configured to be gripped and form a support point for a person's body as the person moves their torso toward or away from the elongated member.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
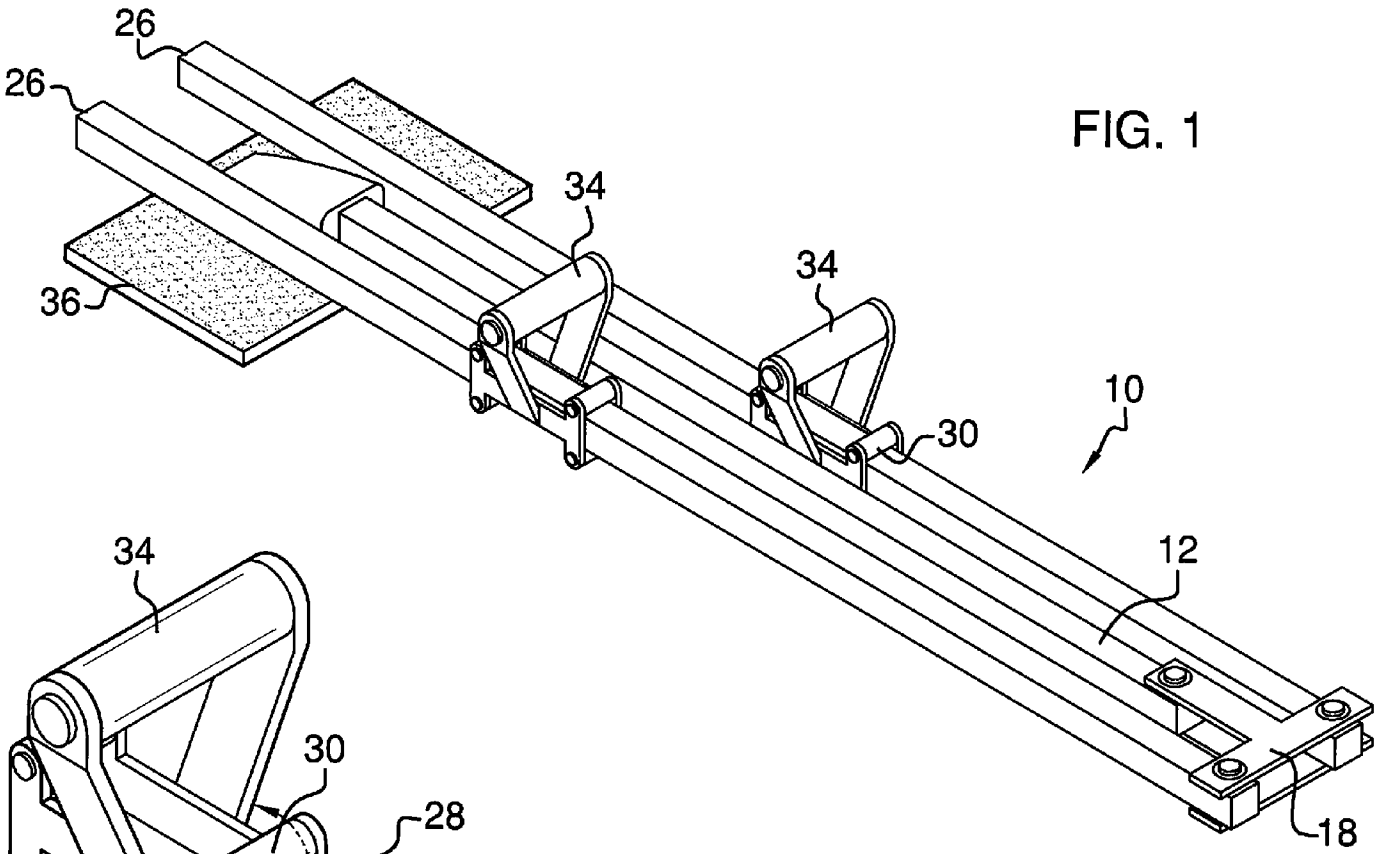
FIG. 1 is a top perspective view of a exercising assembly according to an embodiment of the disclosure.
Figure 2:
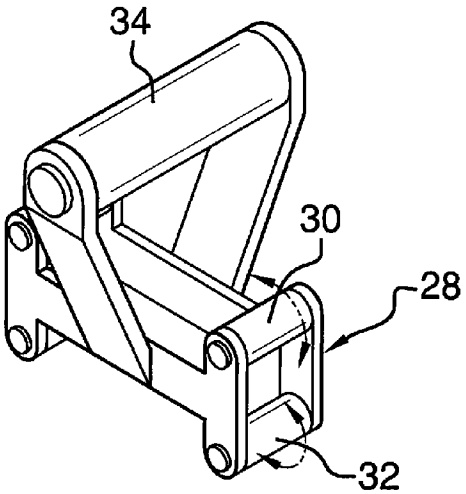
FIG. 2 is a top perspective view of a carriage of an embodiment of the disclosure.
Figure 3:
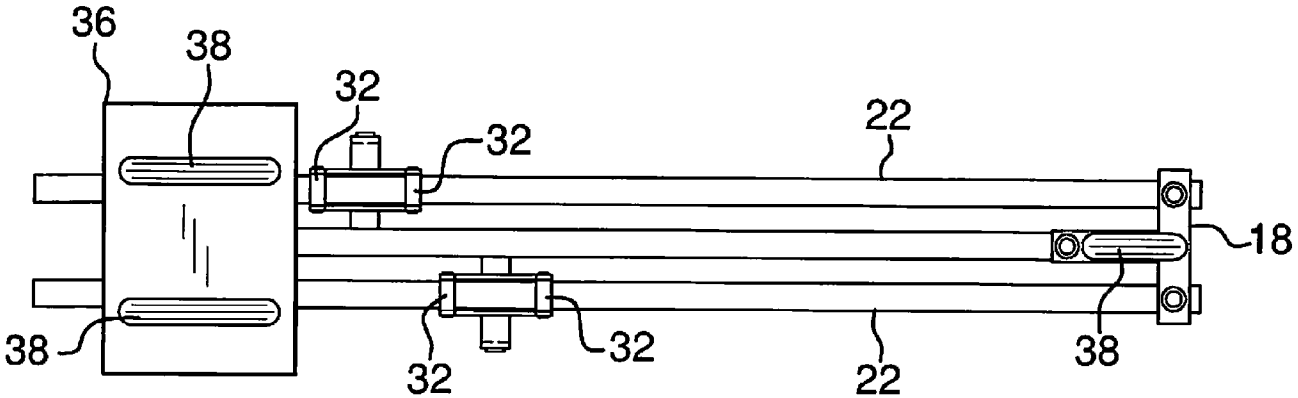
FIG. 3 is a top view of an embodiment of the disclosure.
Figure 4:
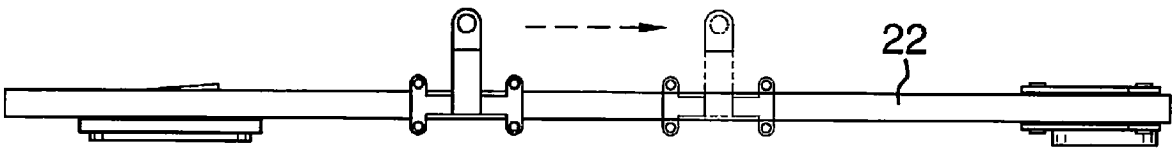
FIG. 4 is a side view of an embodiment of the disclosure.

With reference now to the drawings, and in particular to FIGS. 1 through 6 thereof, a new abdominal exercising device embodying the principles and concepts of an embodiment of the disclosure and generally designated by the reference numeral 10 will be described.

Figure 5:
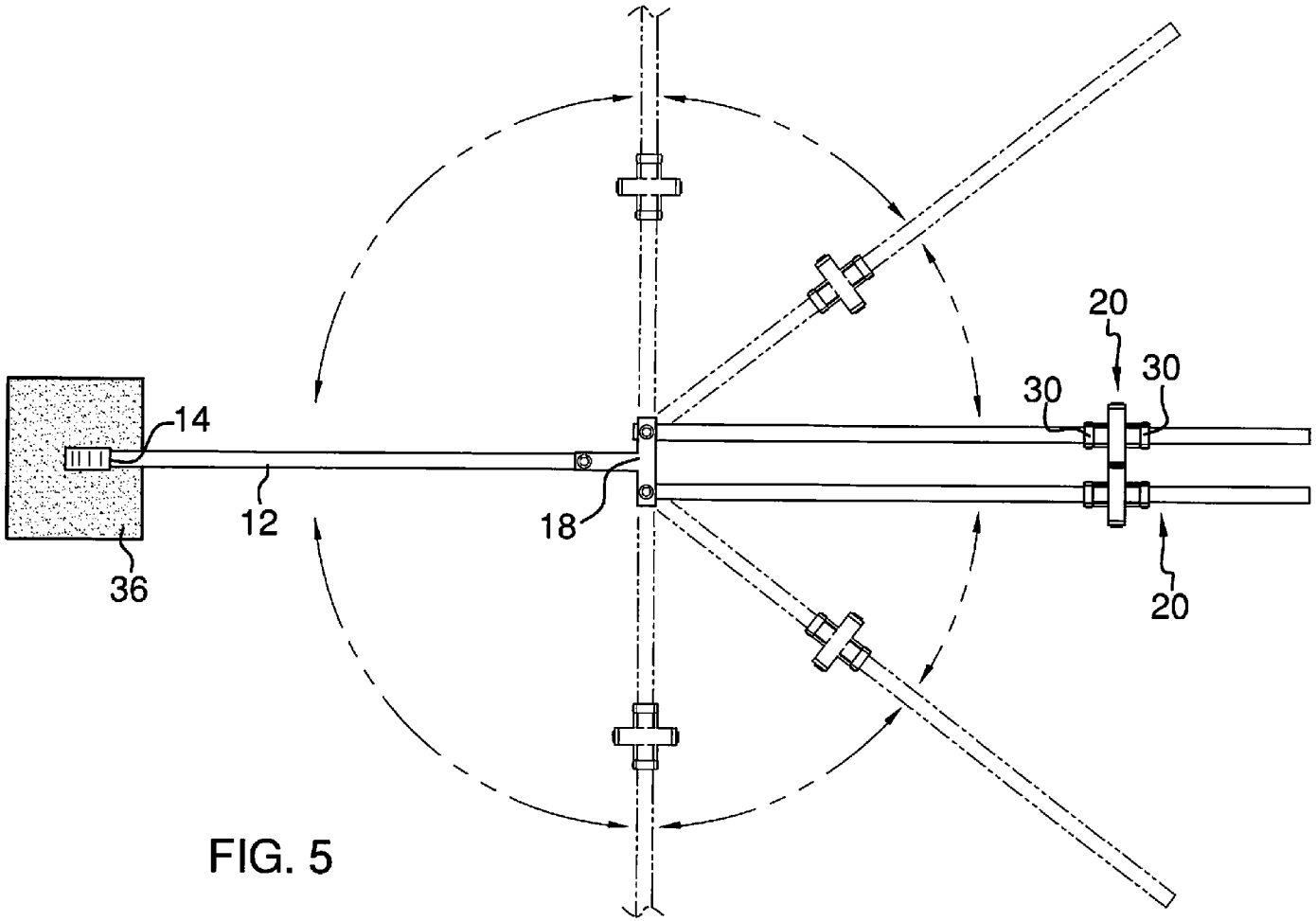
FIG. 5 is a top view of an embodiment of the disclosure.
Figure 6:
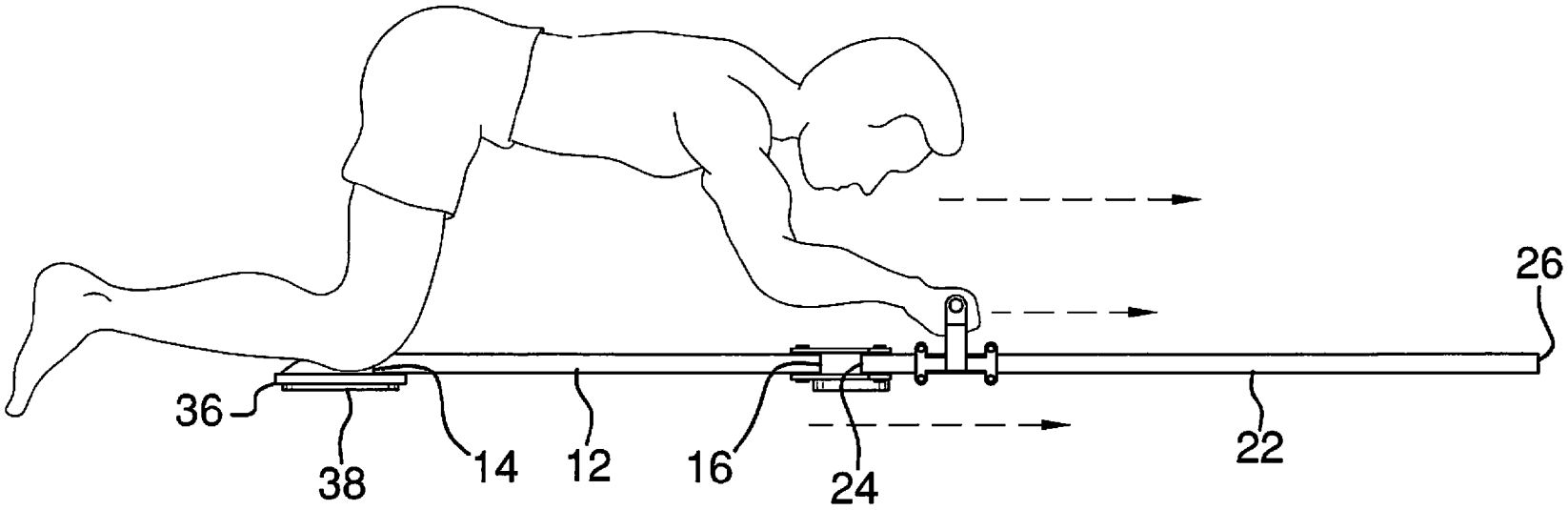
FIG. 6 is a side in-use view of an embodiment of the disclosure.

As best illustrated in FIGS. 1 through 6, the exercising assembly 10 generally comprises an elongated member 12 that has a first end 14 and a second end 16. The elongated member 12 has a length between about 3.0 feet and 4.0 feet and a width less than 0.5 feet. A mount 18 is attached to the second end 16 of the elongated member 12. The mount 18 may be T-shaped as shown in FIG. 5.

A pair of body extenders 20 is provided. Each of the body extenders 20 is attached to the mount 18 and the elongated member 12 is positioned between the body extenders 20. The body extenders 20 are configured to be gripped by a user and to be a support point for a person's body as the person moves their torso toward or away from the elongated member 12.

Each of the body extenders 20 comprises an arm 22 having an attached end 24 attached to the mount 18 and a free end 26 positioned opposite of the attached end 24. The arm 22 is pivotally coupled to the mount 18 such that the free end 26 is positionable adjacent to the first end 14 in a stored position or extending away from the elongated member 12 in a fully extended position. The arm 22 is oriented parallel to the elongated member 12 when the arm 22 is in the stored position or in the fully extended position. The arm 22 has a length generally between about 3.0 feet and a 4.0 feet. A carriage 28 is mounted on the arm 22 and is movable between the attached 24 and free 26 ends. The carriage 28 includes a pair of top rollers 30 abutting an upper surface of the arm 22 and a pair of bottom rollers 32 positioned beneath the arm 22. The bottom rollers 32 are abuttable against a floor surface to provide stability for the arm 20. A grip 34 is attached to the carriage 28 above the arm 22. The grip 34 is elongated and is oriented perpendicular to the arm 22. The grip 34 may be rotatable with respect to the carriage 28.

A pad 36 is attached to the elongated member 12 adjacent to the first end 14. The pad 36 extends laterally in opposite directions from the elongated member 12 and is comprised of a resiliently compressible material. As can be seen in the Figures, the pad 36 may be used for supporting the knees of a user of the assembly 10. The bottom of the pad 36 may include footing 38 for gripping a floor surface and a footing 40 may also be positioned on a bottom of the mount 18.

In use, a user places the arms of the body extenders 20 in the fully extended, or deployed, position and places their knees on the pad. The handles 34 are gripped and the user extends the carriages 28 down the arms so that their body comes nearer to the elongated member 12. The user then uses their abdominal muscles to pull their buttocks back again over the pad 36. The arms 22 may be angled outwardly away from a parallel orientation with respect to the elongated member 12 to exercise other muscle groups such as the shoulders.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An exercising assembly configured to assist a user in strengthening abdominal muscles, said assembly comprising:

an elongated member having a first end and a second end;

a mount being attached to said second end of said elongated member;

a pair of body extenders, each of said body extenders being attached to a respective side of said mount, said body extenders being coplanar with said elongated member, said body extenders being configured to be gripped and form a support point for a person's body as the person moves their torso toward or away from said elongated member, wherein each of said body extenders comprises an arm having an attached end attached to said mount and a free end positioned opposite of said attached end, said arm being pivotally coupled to said mount such that said free end is positionable adjacent to said first end in a stored position and extending away from said elongated member in a fully extended position, said arm being oriented parallel to said elongated member when said arm is in said stored position and in said fully extended position, a carriage being mounted on said arm and being movable between said free and attached ends, and a grip being attached to said carriage above said arm.

2. The exercising assembly according to claim 1, wherein said carriage includes a pair of top rollers abutting an upper surface of said arm.

3. The exercising assembly according to claim 1, wherein said carriage includes a pair of bottom rollers being positioned beneath said arm and being abuttable against a floor surface.

4. The exercising assembly according to claim 2, wherein said carriage includes a pair of bottom rollers being positioned beneath said arm and being abuttable against a floor surface.

5. The exercising assembly according to claim 1, wherein said grip is elongated and is oriented perpendicular to said arm.

6. The exercising assembly according to claim 1, further including a pad being attached to said elongated member adjacent to said first end, said pad extending laterally in opposite directions from said elongated member, said pad being comprised of a resiliently compressible material.

7. The exercising assembly according to claim 1, further including a pad being attached to said elongated member adjacent to said first end, said pad extending laterally in opposite directions from said elongated member, said pad being comprised of a resiliently compressible material.

8. An exercising assembly configured to assist a user in strengthening abdominal muscles, said assembly comprising:

an elongated member having a first end and a second end;

a mount being attached to said second end of said elongated member;

a pair of body extenders, each of said body extenders being attached to a respective side of said mount, said body extenders being coplanar with said elongated member, said body extenders being configured to be a support point for a person's body as the person moves their torso toward or away from said elongated member, each of said body extenders comprising an arm having an attached end attached to said mount and a free end positioned opposite of said attached end, said arm being pivotally coupled to said mount such that said free end is positionable adjacent to said first end in a stored position and extending away from said elongated member in a fully extended position, said arm being oriented parallel to said elongated member when said arm is in said stored position and in said fully extended position, a carriage being mounted on said arm and being movable between said free and attached ends, said carriage including a pair of top rollers abutting an upper surface of said arm and a pair of bottom rollers being positioned beneath said arm and being abuttable against a floor surface, and a grip being attached to said carriage above said arm, said grip being elongated and being oriented perpendicular to said arm; and a pad being attached to said elongated member adjacent to said first end, said pad extending laterally in opposite directions from said elongated member, said pad being comprised of a resiliently compressible material.

* * * * *